US006164304A

United States Patent [19]

Headley

[11] Patent Number: 6,164,304

[45] Date of Patent: Dec. 26, 2000

[54] UMBRELLA

[75] Inventor: Ann S. Headley, Cincinnati, Ohio

[73] Assignee: totes Isotoner Corporation, Cincinnati, Ohio

[21] Appl. No.: 09/257,515

[22] Filed: Feb. 25, 1999

[51] Int. Cl.[7] ..... A45B 25/18; A45B 25/12

[52] U.S. Cl. ..... 135/34.2; 135/33.2

[58] Field of Search ..... 135/25.4, 34.2, 135/37, 33.2, 15.1, 16

[56] References Cited

U.S. PATENT DOCUMENTS

| | | |
|---|---|---|
| 276,457 | 4/1883 | Odiorne . |
| 1,287,596 | 12/1918 | Weinberg . |
| 2,742,913 | 4/1956 | Weisblatt . |
| 3,818,920 | 6/1974 | Oyama et al. . |
| 4,007,753 | 2/1977 | DeMarco . |
| 4,232,693 | 11/1980 | Matsuda . |
| 4,336,817 | 6/1982 | Shapiro . |
| 4,375,222 | 3/1983 | Dubinsky . |
| 4,542,757 | 9/1985 | Phillips . |
| 4,930,533 | 6/1990 | Allen . |
| 5,046,446 | 9/1991 | Sumrall et al. . |
| 5,080,118 | 1/1992 | Allen . |

*Primary Examiner*—Robert Canfield
*Attorney, Agent, or Firm*—Wood, Herron & Evans, LLP

[57] ABSTRACT

The umbrella has a tie strap with a width preferably of at least about one-half the length of a rib linkage's cover rib so that the tie strap tends to function as a cover for a collapsed and furled umbrella. The tie strap preferably has a centerline that is substantially normal to the umbrella's centerpost when the umbrella is fully collapsed so that when the tie strap is wrapped around the umbrella, the cover rib linkages are neatly held with less bunching being visible to the user's eye than if a prior art tie strap were used.

14 Claims, 3 Drawing Sheets

UMBRELLA

This invention relates to umbrellas. More specifically, this invention relates to an umbrella with a novel tie strap.

Collapsible umbrellas are well known in the art to have multiple section rib linkages so that an umbrella having a relatively large cover when open may be closed into a relatively small or short umbrella package that may be carried, for example, in a purse or a coat pocket. This collapsible umbrella rib linkage structure is in sharp contrast with a traditional umbrella with a single section rib linkage that, when collapsed, may be up to a yard or more in length. Whether an umbrella is of the single rib linkage type, or multiple rib linkage type, it is well known to provide these umbrellas with a tie strap attached to the umbrella cover so that, when the umbrella is closed, the tie strap may be wrapped around the cover in order to maintain the rib linkages in close proximity with the centerpost and to keep the cover gores furled around the centerpost.

As is often the case, after a user is caught in a rain shower and attempts to close a collapsible umbrella, the multi-section rib linkages and the wet umbrella cover are difficult to collapse and furl quickly and neatly. This closing/furling problem is compounded in umbrellas having multiple rib linkage sections because the cover may fold several times upon itself when the rib linkages are closed against the centerpost. In these multi-rib linkage collapsible umbrellas, the resultant folds in the cover when the umbrella is closed are difficult to straighten, align neatly with each other, and furl against the centerpost, without having the cover bunch up and, thereby, inconvenience the user. The result of an attempt to furl a wet umbrella cover with prior art tie straps is, generally, a mess of mis-furled cover gores which makes the collapsed umbrella difficult to handle and inconvenient to carry. In the event that a user keeps a carrying case handy in which to stow the wet umbrella, the mis-furled cover gores make it time consuming and difficult to insert the collapsed umbrella into the carrying case.

It has therefore been an objective of the present invention to provide an umbrella having multi-section rib linkages that may be more easily furled in order to save the user time and inconvenience.

It is a further object of the present invention to provide an umbrella with a simulated case attached to the umbrella cover.

The objectives of the present invention are achieved for an umbrella that has a cover attached to a plurality of collapsible rib linkages, each rib linkage having multiple sections, e.g., a topless inner linkage, a first middle cover rib, a second middle cover rib and an outer cover rib. When the rib linkages are collapsed against the umbrella's centerpost, the outer cover rib of the rib linkage is substantially parallel to the centerpost.

A tie strap is attached to the umbrella cover which, in preferred form, has a width of at least about one-half of the length of a cover rib so that when a user closes and furls the umbrella, the tie strap tends to function as a cover for the umbrella as well as to function as a tie strap. The tie strap preferably has a centerline substantially normal to the centerpost so that when a user furls the closed cover around the centerpost, the tie strap does not tend to spiral up or down the furled umbrella.

Other objectives and advantages of the invention will be more apparent from the following detailed description taken in conjunction with the drawings in which.

Figure 1:
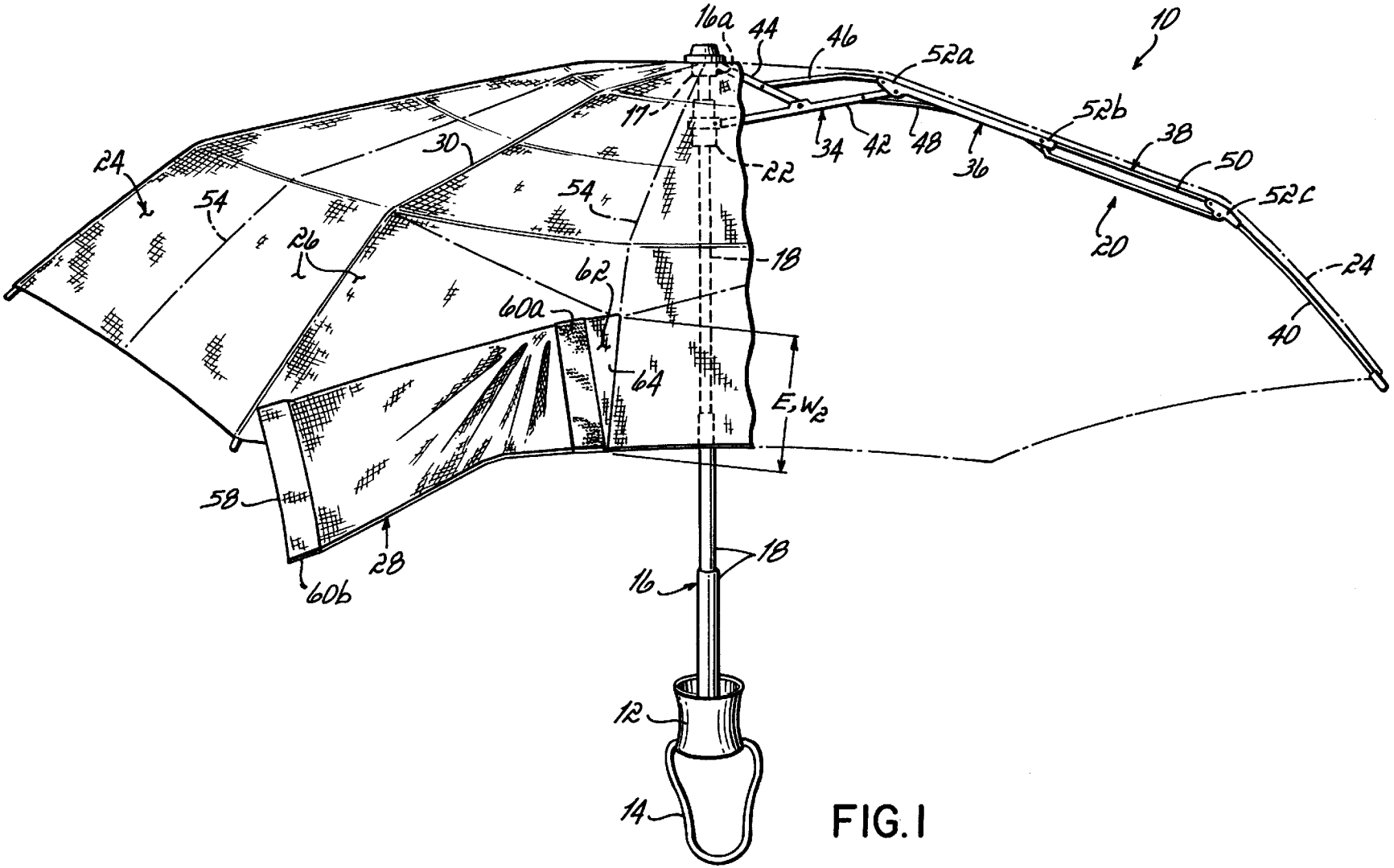
FIG. 1 is a perspective partially cutaway view of an umbrella having a tie strap in accord with the present invention.
Figure 2:
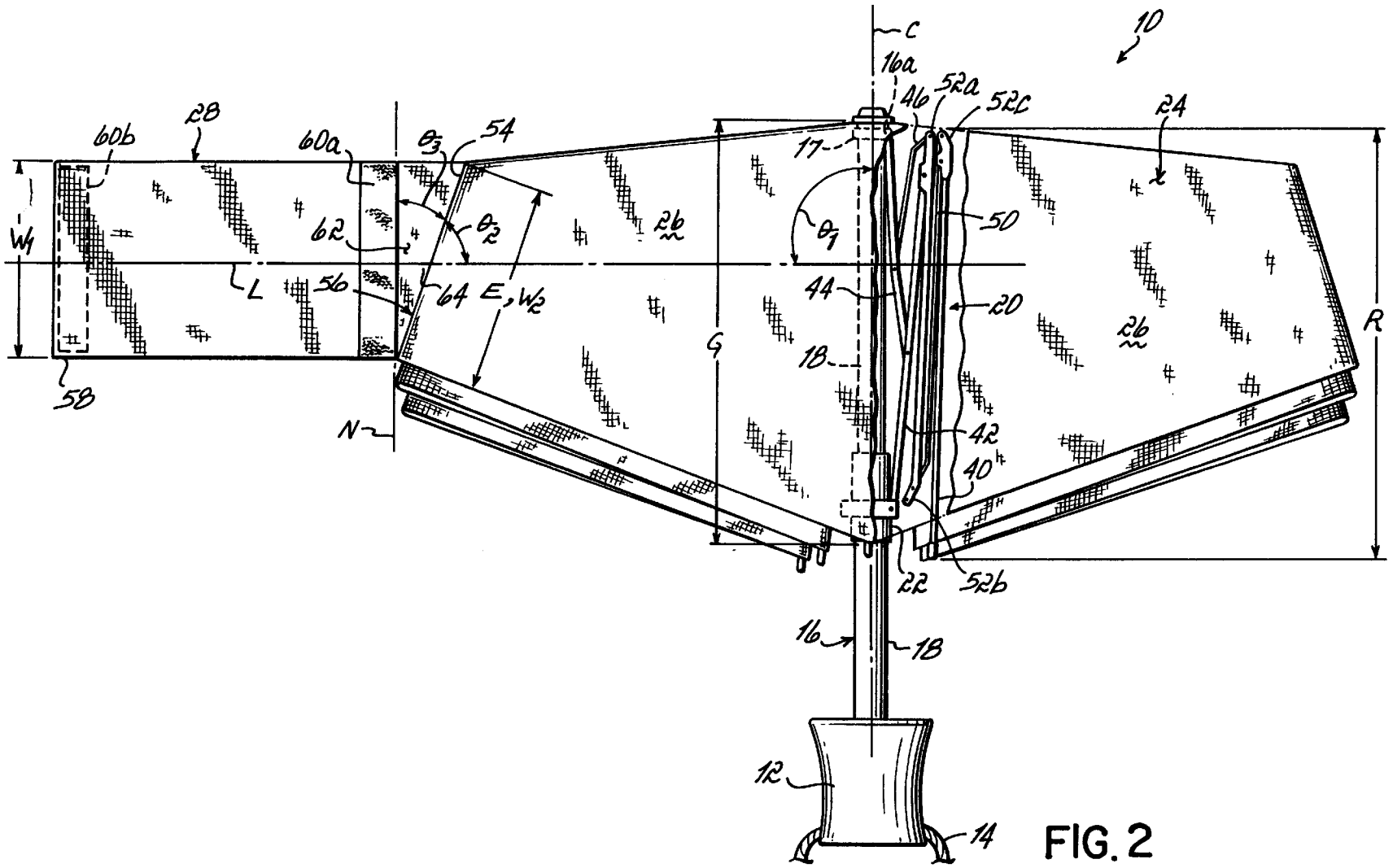
FIG. 2 is a side elevational view of the umbrella of FIG. 1, but in a partially closed state.
Figure 3:
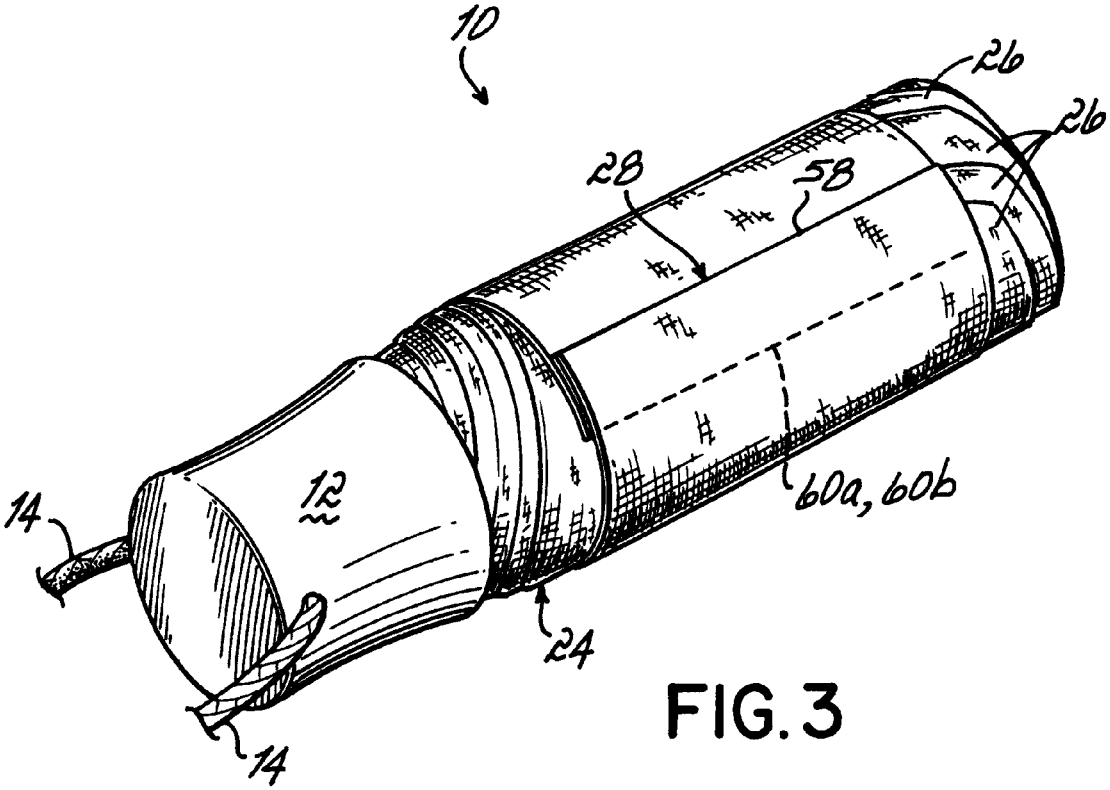
FIG. 3 is a perspective view of the umbrella of the present invention in its fully closed state.

This invention is directed to an umbrella 10 having a handle 12 with a wrist strap 14 connected to a telescoping centerpost 16 having a plurality of telescoping sections 18, as is seen generally in FIGS. 1–3. The umbrella 10 has a plurality of multi-section rib linkages 20, each being attached to the centerpost 16 at the ferrule 17, and with a slidable runner 22, so that the rib linkages 20 may be raised and lowered in order to open (see FIG. 1) and close (see FIGS. 2 and 3) the umbrella 10. A cover 24 having plural gores 26 is attached to the rib linkages 20, and a tie strap 28 in accord with the principles of this invention is attached to a single gore 26 to neatly furl the gores 26 when the umbrella 10 is collapsed, see FIG. 3. The gores 26 are stitched together along stitch lines 30 which generally overlay the rib linkages 20.

In the preferred embodiment, a single rib linkage 20 has four rib linkage sections, i.e., an inner topless linkage 34 section, a first middle cover rib 36 section, a second middle cover 38 rib section, and an outer cover rib 40 section. The inner linkage 34 section has a first strut 42 pivotally attached to the runner 22 and the first middle cover rib 48, a second strut 44 pivotally attached to the top 16*a* of the centerpost 16 and to the first strut 42 approximately medially along the first strut's 42 length, and a third strut 46 pivotally attached to the second strut 44 approximately medially along the second strut's 44 length and to one end of the first middle cover rib 36. As will be understood by those in the art, the inner linkage 34 section, first middle cover rib 36, second middle cover rib 38 and outer cover rib 40 are pivotally attached to each other and to the centerpost 16 by means in which the rib linkage 20 is allowed to pivot at each point of attachment.

The first middle cover rib 36 is pivotally attached to the inner linkage 34 and to the second middle cover rib 38. The first middle cover rib 36 has a tension rib 48 that springably acts to help extend the rib linkage 20 and maintain the umbrella 10 open. The second middle cover rib 38 is pivotally attached to the first middle cover rib 36 and the outer cover rib 40. The second middle cover rib 38 has a tension rib 50 that springably acts to help extend the rib linkage 20 and maintain the umbrella 10 open. The outer cover rib 40 is pivotally attached to the second middle cover rib 38 and the outer periphery or margin of the cover 24 to stretch the cover 24 open when a user opens the umbrella 10. As will be understood by those in the art, the present invention is also applicable to collapsible umbrellas having multi-section rib linkages with a number of linkage sections other than four, as seen in U.S. Pat. Nos. 4,627,455 and 5,193,565, owned by the assignee of the present invention.

The cover 24 may be loosely tied with thread (not shown) adjacent to pivot joints 52*a*, 52*b*, 52*c* to help keep the cover 24 in close proximity to the rib linkage 20 as the umbrella 10 is opened and closed. When the umbrella 10 is closed, the outer cover rib 40 remains the outermost section of the rib linkage 20 relative to the centerpost 16, and it is oriented generally parallel to the centerpost 16. The outer cover rib 40 has a length R which substantially corresponds to width G of the gore 26 overlying the outer cover rib 40 when the gore is folded, i.e., when the umbrella is in an intermediate open/close position as shown in FIG. 2 where the rib linkages 20 are collapsed but the cover is not furled.

The cover 24 is fixed to the rib linkages 20 so that each gore 26 spans a pair of adjacent rib linkages 20. A fold line 54 bisects each gore 26. The fold line 54 is formed when the umbrella 10 is closed and the rib linkages 20 contract upon the centerpost 16, as seen in FIG. 2. When the rib linkages 20 are collapsed upon the centerpost 16, the collapsed gores 26 undulate between adjacent rib linkages 20 due to the thread (not shown) tying the cover 24 to the joints 52*a*, 52*b*, 52*c*, leaving the umbrella 10 in a closed, but unfurled condition. In this closed but unfurled condition, each gore 26 has a fold edge 56 occurring about midway between adjacent cover ribs 40 when rib linkages 20 are collapsed and are substantially parallel to the centerpost 16, and when the gore 26 is laid out flat. The fold edge 56 is generally coextensive with the fold line 54.

The tie strap 28 is affixed along substantially the entire length E of the fold edge 56 of one gore 26, see FIGS. 1 and 2. In the preferred embodiment, the tie strap 28 has a free end 58 with a width $W_1$. However, the tie strap 28 has a gore end 64 with a width $W_2$ substantially equal to the length E of the fold edge 56.

So that the tie strap 28 may be secured to itself when wrapped around a closed umbrella 10, the tie strap 28 is provided with a hook and loop-type fastener 60*a*, 60*b* on opposing sides of the tie strap 28. The hook and loop-type fasteners 60*a*, 60*b* are attached to the tie strap 28 so that they are substantially parallel to the centerpost centerline C when the umbrella 10 is closed. It will be understood that any suitable fastener known in the art may be used to secure the tie strap 28 to itself. It also will be understood by those in the art that the tie strap 28 has a length sufficient to wrap around the closed umbrella 10, so that the tie strap 28 may be secured to itself as shown in FIG. 3.

In use, when a user collapses the umbrella 10 and the gores 26 are left unfurled, as shown in FIG. 2, they undulate between adjacent rib linkages 20. A user wraps the tie strap 28 around the umbrella 10 so that the outer cover ribs 40 are held in substantially parallel collapsed configuration against the centerpost 16. The tie strap's width $W_1$ ensures that the undulating gores 26 appear to be neatly furled about the centerpost 16 with a minimum of bunching, and ensures that all the individual rib sections of the multi-section rib linkages 20 are held securely against the centerpost so that same are not damaged when the umbrella is stored. The tie strap width $W_1$ must be at least about one-third the length R of the outer cover rib 40, and in the most preferred embodiment, the tie strap width $W_2$ is at least about one-half of the length R of the outer cover rib 40.

The user then secures the tie strap 28 against itself with the hook and loop-type fastener 60*a*, 60*b*. So fixed, the tie strap 28 tends to function as a case for the collapsed umbrella 10 due to its width $W_1$ relative to the cover rib length R, see FIG. 3.

The tie strap 28 has a centerline L which forms an angle $\theta_1$ that is substantially normal, i.e., about 90°, to the centerpost's centerline C when the umbrella 10 is collapsed and the cover ribs 40 are substantially parallel to the centerpost 16, but the cover is not furled about the centerpost, as shown in FIG. 1. In this intermediate open/close position, the gore fold edge 56 forms an angle $\theta_2$ with the tie strap centerline L. A gusset panel 62 connects the tie strap gore end 64 along the gore fold edge 56 to locate the tie strap centerline L substantially normal to the centerpost centerline C. A phantom line N normal to the tie strap centerline L creates an angle $\theta_3$ with the gore fold edge 56. So the tie strap centerline L is maintained normal to the centerpost centerline C by the equation:

$$\theta_2+\theta_3=\theta_1$$

Thus, when the tie strap 28 is maintained normal to the centerpost 16 as the umbrella 10 is closed, as shown in FIG. 2, a user may furl the gores 26 around the centerpost 16 without spiraling the tie strap 28 up or down the furled umbrella 10 so the closed umbrella appears neatly packaged to the user's eye. The ability to maintain the tie strap 28 normal to the centerpost 16 during furling helps prevent the gores 26 from bunching in a disorderly fashion around the centerpost 16.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. An umbrella, comprising a plurality of rib linkages attached to a centerpost, each of said rib linkages having an outer cover rib, a cover attached to said rib linkages, said cover having a plurality of gores, and a tie strap attached to one of said gores, said tie strap having a width at least about one-third the length of an outer cover rib, said tie strap being adapted to wrap around at least about one third the length of each outer cover rib and the furled umbrella cover when said umbrella is closed and said tie strap is wrapped around said centerpost, thereby ensuring that said rib linkages and said furled cover are held in collapsed configuration against said centerpost.

2. The umbrella of claim 1, wherein each said rib linkage has at least two sections.

3. The umbrella of claim 2, wherein said tie strap has a width of about one-half of the length of said cover rib.

4. The umbrella of claim 3, wherein said gores are each bisected by a fold line, said tie strap being attached to one of said gores substantially along said fold line.

5. The umbrella of claim 4, wherein that gore to which said tie strap is attached presents a fold edge that overlies said fold line, the length of said tie strap being about equal to the length of said fold edge.

6. The umbrella of claim 3, wherein said tie strap has a centerline substantially normal to said centerpost when said rib linkages are collapsed but said cover is not furled.

7. An umbrella having a cover, a centerpost, and plural rib linkages, each rib linkage having an outer cover rib, said outer cover ribs being of substantially equal length one with the other, said umbrella comprising a tie strap attached to said cover having a width at least about one-half of a cover rib's length, so that when said tie strap is wrapped around said centerpost it tends to function as a case for the wrapped furls of said cover and the collapsed rib linkages.

8. The umbrella of claim 6, wherein said rib linkages each have at least two sections.

9. The umbrella of claim 7, wherein said cover has a fold line located approximately medially between a pair of adjacent cover ribs, said tie strap being attached to said cover generally along said fold line.

10. An umbrella, comprising a plurality of rib linkages attached to a centerpost, each of said rib linkages having an outer cover rib, a cover attached to said rib linkages, said cover having a plurality of gores, each of said gores spanning a pair of adjacent rib linkages and having a fold line bisecting one of said gores when said umbrella is collapsed, and a tie strap attached to said one of said gores substantially along an outer fold edge oriented on said fold line, said tie strap having a centerline creating a first angle of about 90° with said centerpost when said rib linkages are collapsed but said cover is not furled.

11. The umbrella of claim 10, wherein said tie strap's centerline creates a second angle with said fold edge and a line normal to said tie strap center line creates a third angle with said fold edge, wherein the sum of said second angle and said third angle equals about 90°.

12. The umbrella of claim 10, wherein said rib linkages each have at least two sections.

13. The umbrella of claim 12, wherein said tie strap has a width at least about one-third of said cover rib's length.

14. An umbrella, comprising a plurality of rib linkages each having at least two sections, each of said rib linkages having an outer cover rib and being attached to a centerpost, a cover attached to said rib linkages, said cover having a plurality of gores, each of said gores spanning a pair of adjacent said rib linkages and having a fold line bisecting one of said gores when said cover is collapsed, a tie strap attached to one of said gores substantially along said fold line, said tie strap having a centerline normal to said centerpost when said rib linkages are closed and said cover is not furled, said tie strap having a hook and loop-type fastener so that when wrapped around the umbrella when closed, said tie strap attaches to itself, wherein said tie strap has a width of at least about one-half of said cover rib's length so said tie strap tends to form a case around said umbrella when closed and said tie strap is attached to itself.

* * * * *